US011833384B2

(12) United States Patent
Jezwinski

(10) Patent No.: US 11,833,384 B2
(45) Date of Patent: Dec. 5, 2023

(54) RESISTANCE BANDS APPARATUS

(71) Applicant: Travis Jezwinski, Littleton, CO (US)

(72) Inventor: Travis Jezwinski, Littleton, CO (US)

( * ) Notice: Subject to any disclaimer, the term of this patent is extended or adjusted under 35 U.S.C. 154(b) by 111 days.

(21) Appl. No.: 17/669,620

(22) Filed: Feb. 11, 2022

(65) Prior Publication Data

US 2023/0256285 A1 Aug. 17, 2023

(51) Int. Cl.
*A63B 21/055* (2006.01)
*A63B 21/04* (2006.01)
*A63B 21/00* (2006.01)

(52) U.S. Cl.
CPC .... *A63B 21/0557* (2013.01); *A63B 21/00069* (2013.01); *A63B 21/0442* (2013.01); *A63B 21/0555* (2013.01); *A63B 21/4035* (2015.10)

(58) Field of Classification Search
CPC ..... A63B 21/0557; A63B 21/00069; A63B 21/0442; A63B 21/0555; A63B 21/4035
See application file for complete search history.

(56) References Cited

U.S. PATENT DOCUMENTS 5,885,196 A * 3/1999 Gvoich ..... A63B 21/00185 482/125
10,758,771 B1 * 9/2020 Cranke ..... A63B 21/4015
11,331,529 B1 * 5/2022 Cranke ..... A63B 21/4021
2005/0054497 A1 * 3/2005 Hull ..... A63B 21/4013 482/110
2005/0113222 A1 * 5/2005 Dovner ..... A63B 21/00043 482/121
2012/0035031 A1 * 2/2012 Silverman ..... A63B 21/1645 482/139
2012/0329618 A1 * 12/2012 White ..... A63B 21/0552 482/126
2013/0203567 A1 * 8/2013 Thomas ..... A63B 21/00043 482/124
2014/0256514 A1 * 9/2014 Garner ..... A63B 21/055 482/91
2016/0287927 A1 * 10/2016 Hunter ..... A63B 21/0552
2018/0178050 A1 * 6/2018 Prihar ..... A63B 21/4035
2018/0185693 A1 * 7/2018 Thurston ..... A63B 21/0407
2019/0240529 A1 * 8/2019 Burkinshaw ..... A63B 21/4043
2021/0178224 A1 * 6/2021 Cooley ..... A63B 21/0557

* cited by examiner

*Primary Examiner* — Andrew S Lo

(57) ABSTRACT

The present disclosure provides a resistance band apparatus which overcomes the problems traditionally associated with resistance training—time consuming resistance changes during the same exercise, time consuming adjustments between different exercises, and non-uniform resistance through the exercise motion depending on the height and limb length of the person—by incorporating multiple bands of different resistances into a single apparatus that can be engaged or disengaged from contributing towards the total resistance provided during an exercise, and which can be attached and detached at different points along the length of the apparatus to variations of fixed anchors to provide uniform tension and length for exercise motion. Both the resistances of the different bands and the points along the length of the apparatus at which they are attached are clearly indicated to facilitate easier recording of progress, as well as apparatus setup per exercise for the user.

10 Claims, 3 Drawing Sheets

RESISTANCE BANDS APPARATUS

FIELD OF INVENTION

The present invention relates generally to a resistance band apparatus. More specifically, the present invention relates to a resistance band apparatus comprising of multiple bands of different resistance profiles, all attached and self-contained in the apparatus by design, and which can be attached and detached to anchor systems and dynamically provide different lengths of the apparatus band structure, depending on the exercise as well as user height and general limb length, and also dynamically switch between different resistances, quickly and efficiently.

BACKGROUND

The advantages of resistance bands in strength and conditioning training are well known, and their use has grown exponentially in recent years with more people desiring to have a legitimate home workout option, as well as many top personal trainers incorporating them heavily into their routines. Bands provide a fantastic combination of portability, flexibility, safety, and exercise efficiency, allowing a user to perform a wide range of motions and exercises by stretching the length of the elastic in the bands away from a designated fixed anchor point to which the bands are attached during a particular exercise.

Traditionally, tube style bands have comprised a single standard-length of elastic with handles on each end. When in use, the middle of the band would either be put around an anchor or stood upon while an exercise was performed with the handles. Each band has a different resistance, which is predicated on the thickness of the length of elastic. Thus, when a user wants to change resistances, they must use a different band set with handles, or switch out or add individual bands to the same set of handles, to achieve the desired resistance. In recent years, varying resistances of standard-length tubes are able to attach, and detach via carabiners, from a common set of handles. This allows not only various resistances of single bands to be switched, but also, for multiple bands to be attach to the common handles, for greater resistance than any of the single bands.

There are several major issues with resistance band training which still deter some users from favoring them over standard free weightlifting or lifting with machines.

Firstly, the requirement of switching between different resistances is time consuming and cumbersome, because the user has to switch the entire band and handles out, or unhook bands from the common set of handles, and then get back into the exercise position they were in and try to get anchored as they were for the particular exercise. The constant switching between various bands, between various exercises, makes it very difficult to keep track of which band, or bands, were used with each exercise, making it difficult to track performance and progress systematically. This constant time-consuming switching makes it difficult to perform exercises with minimal rest between exercise sets, which is desirable.

Secondly, the inability to alter the length of the bands, given they are fixed lengths, and working with a typical fixed anchor point limits the ability of resistance bands to adapt to users of different heights and limb lengths, and to different exercises. Since the bands will flex more or less per exercise depending on if one is a taller or shorter person or has longer or shorter legs/arms (limbs), it is difficult for a user to ensure they are using consistent resistance per exercise, which in turn also makes it more difficult to track performance and progress. Given the fixed lengths of bands, a shorter person, is often forced to not use the provided handles, but rather, try to grip the elastic tubes themselves, in order to have resistance throughout the entire motion of the exercise, which is a significant inconvenience as well as far less grip to perform the exercise.

While there have been many developments in resistance band systems in recent years, there are no solutions to solve the aforementioned problems.

Prior art patent publication No. US2018185693A1 by Thurston Greg et al discloses an exercise apparatus that includes a plurality of bands. Each band has a first end and a second end. The first end is configured to attach to a secure object. The apparatus includes a seat that has a first attachment end and a second attachment end. Each attachment end is selectively attachable to the second end of each band so as to vary a resistance between the secure object and the seat.

Prior art patent publication No. US2013203567A1 by Thomas Karl discloses an exercise device in the form of an adjustable resistance multi-use toning system that includes a plurality of elongated elastic bands (tension bands or cables) which can have different tension (resistance) values. Each band has a first end and an opposing second end. The device further includes a hollow sleeve that receives at least a portion of each of the elastic bands so as to at least partially envelope the elastic bands while permitting the first and second ends to be accessible. A first fastener is provided for attaching the first ends of the elastic bands to a support member, such as a piece of exercise equipment, a belt to be worn around a body part of a user; or any other structure to which the exercise device can be attached.

Neither US2018185693A1 nor US2013203567A1 teach the solution provided by the proposed invention.

It is within this context that the present invention is provided.

SUMMARY

The present disclosure provides a resistance band apparatus which overcomes the problems traditionally associated with resistance training—time consuming resistance changes during the same exercise, time consuming adjustments between different exercises, and non-uniform resistance through the exercise motion depending on the height and limb length of the person— by incorporating multiple bands of different resistances into a single apparatus and the bands can be engaged or disengaged from contributing towards the total resistance provided during an exercise, and which can be attached and detached at different points along the length of the apparatus to variations of fixed anchors to provide uniform tension and length for each type of exercise being performed. Both the selection use of different bands, for resistance variation, and the points along the length of the apparatus at which they are attached to variations of fixed anchors, are clearly indicated to facilitate exactly how the apparatus was connected to a particular anchor for a particular exercise, as well as what specific resistance amount was used for that exercise, the exact exercise resistance and setup can be tracked.

Thus, according to one aspect of the present disclosure there is provided a resistance band apparatus, comprising: a handle; a first carabiner coupled to the handle; two or more resistance bands, each resistance band comprising a length of elastic material having a first O-ring disposed at a first end of the length of elastic which is configured to detachably couple to the first carabiner and a second O-ring at the opposing end; a second carabiner coupled to the second O-ring of each resistance band; and a length of webbing having a first D-ring at one end of the length which attaches to the second carabiner and one or more second D-rings that are attached to a nylon strap disposed along its length to couple to the second O-rings of the resistance bands, each D-ring having a corresponding label.

Each resistance band is configured with a thickness to provide a set profile of elastic resistance to deformation by stretching which is different from each other resistance band of the apparatus, the thickness and thus level of resistance provided by each resistance band being indicated by a distinct marking and coloration of the band.

In some embodiments, the apparatus further comprises a sheath, or clear tube, configured to enclose and hold together each of the resistance bands when exercising, and, when not exercising.

The sheath may be a piece of nylon fabric provided with hook and loop elements to detachably wrap around the two or more resistance bands, or alternatively, it may be a clear plastic tube, either of which will enclose and hold the resistance bands together.

In some embodiments, the first and/or second end of the elastic length of each resistance band is attached to the second O-ring by a webbing loop. The coupling between the length of elastic and the webbing loop may be formed by passing the elastic length through a grommet that overlaps the ends of the nylon loop, holding it together, the elastic length of each resistance band having a thicker profile at the end(s) so as to have a greater diameter than the width of the opening of the grommet(s).

In some embodiments, the handle comprises a plastic tunnel grip having a length of nylon webbing looped through, and the nylon webbing couples to the first carabiner.

In some embodiments, the apparatus comprises five resistance bands of different colors and resistances, such that a user may control the total resistance level provided by the apparatus on a scale of 1-15 by attaching different numbers of the first O-rings, which are affixed to the bands, to the first carabiner, which is attached to the handle of the apparatus.

In some embodiments, the D-rings on the length of nylon webbing are evenly spaced from one another and labelled numerically to provide users with a range of length settings which are uniform and easily recorded, as they are attached to variations of fixed anchors, typically hooks, for each exercise.

In some embodiments, the length of webbing having the D-rings disposed along its length is a single piece of nylon wrapped around in a loop with the ends meeting in the middle. The loop is provided with box stitching along its length to form a solid strap.

BRIEF DESCRIPTION OF THE DRAWINGS

Various embodiments of the invention are disclosed in the following detailed description and accompanying drawings.

Figures 1, 2:
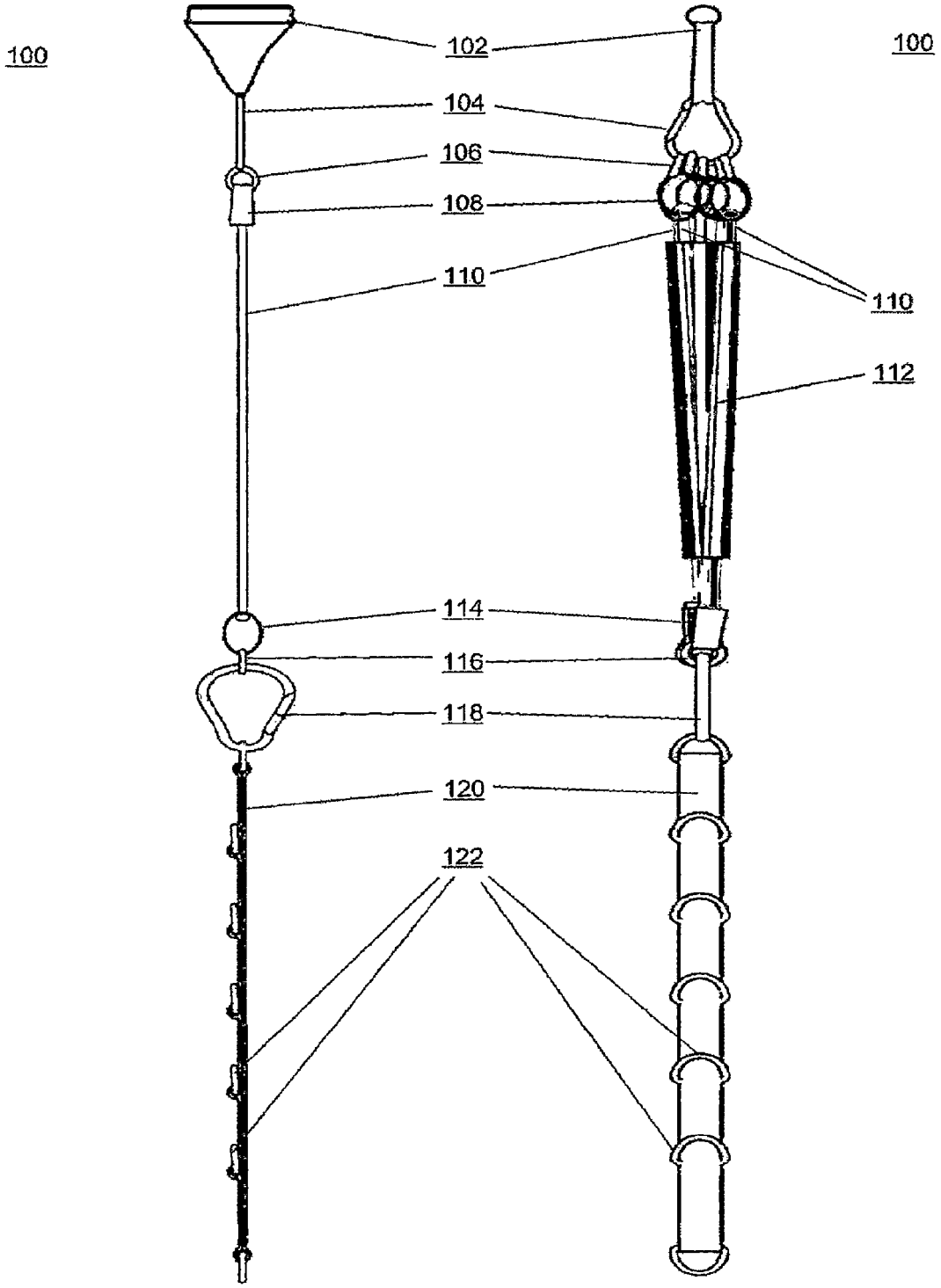
FIG. 1 illustrates a first isometric side view of an example configuration of a resistance band apparatus according to the present disclosure.
FIG. 2 illustrates a second isometric front view of the example configuration of a resistance band apparatus according to the present disclosure.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

The terminology used herein is for the purpose of describing particular embodiments only and is not intended to be limiting of the invention. As used herein, the term "and/or" includes any combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The present disclosure provides a unique and novel design for a resistance band apparatus that overcomes the problems traditionally associated with resistance band training as set out above, facilitating quick and easy switching between different levels of resistance and providing uniform lengths from a fixed anchor point to achieve consistent ranges of motion, regardless of user height and limb length.

Both the resistance levels and length points are clearly demarcated to facilitate accurate tracking of performance, progress, anchor attachment for each exercise of a user.

Thus, referring to FIG. 1 and FIG. 2, a side view and front view of an example configuration of a resistance band apparatus 100 according to the present disclosure is shown.

The apparatus 100 together forms a chain of linked components, with the plurality of resistance bands being a middle link in that chain that can be varied by attaching/detaching them. At a first end of the chain is a handle 102 the user holds during a resistance exercise. The handle 102 is generally formed of a plastic tunnel grip with a nylon (or other strong fabric) loop threaded through it. This in turn is coupled to a first carabiner 104, which is connected to one or more of the resistance bands 110 by an O-ring 106 and second nylon loop 108 arrangement in the present example. Each resistance band has such an arrangement on each end of its length in the illustrated configuration.

A more detailed example configuration of the coupling between the elastic length of the resistance bands 110 and the O-rings is provided below with reference to FIGS. 4 and 5. A person of skill in the art will recognize that alternative configurations may be sued to achieve the same effects, as long as the resistance bands are each able to quickly couple or decouple from the first carabiner 104 to alter the total resistance provided by the apparatus.

In the present example, the apparatus 100 comprises five resistance bands 110 of different thickness, color coded to indicate the amount of resistance they contribute to elongation. The opposing end of each band is always couple to a second carabiner 118, in this example by a second nylon loop 114 and O-ring 116 arrangement. However, the bands are designed to be coupled and decoupled from the first carabiner to tailor the amount of total resistance to a user's needs quickly and easily. Thus, while all five bands 110 will always be attached to the apparatus, not all of them need be "engaged". The apparatus 100 may thus also comprise a sheath 112 to hold the bands 110 together during exercises, keeping the O-rings 106 together even when disengaged so that they can be quickly attached for the next exercise.

In the other examples the bands may be labelled or otherwise marked to indicate their resistance level in place of color coding. The inventor of the present application envisages a system where each band is represented by or corresponds to a number, for example between 1 and 5 for five bands, which can then allow a user to add or subtract bands of different numbers to reach predefined resistance levels allowing them to easily track their progress. For example, the strongest band 5 plus the weakest band 1 would equate to a total resistance level of 6, and so on and so forth.

The second carabiner 118 is coupled to a strap or length of webbing 120 which has D-rings 122 disposed at various points along its length. Generally, there will be a first proximal D-ring at one end of the length to which the second carabiner 118 is attached in the default state, and then additional D-rings evenly spaced along the rest of the length of the webbing 120 to which the carabiner may be moved to vary the total length of the apparatus 100 for different exercises or any of the D rings along the strap webbing 120 can hook to an anchor during an exercise.

The D-ring 122 at the opposing end of the webbing 120 would then be hooked onto an anchor point from which the user would pull the handle, stretching the engaged resistance bands 110 and pulling against their combined elastic tension.

Figure 3:
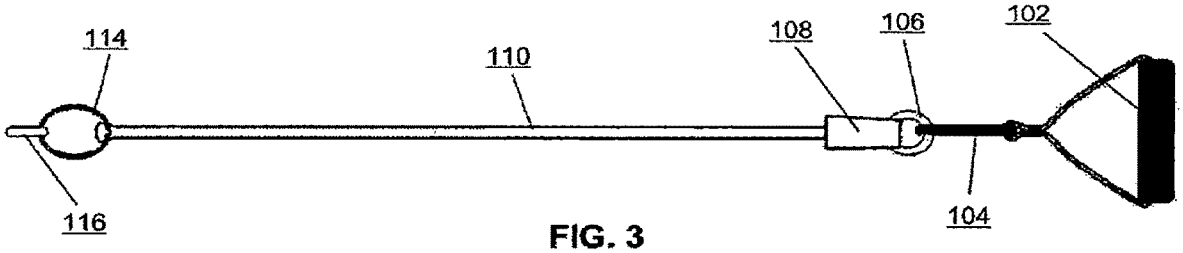
FIG. 3 illustrates an isometric view of the resistance band and handle of the example configuration for use in the disclosed apparatus.

Referring to FIG. 3, an isometric view of the resistance bands 110 attached to the handle 102 is shown. This part of the apparatus 100 can easily be detached from the second carabiner 118 if desired, making it more portable.

Figure 4:
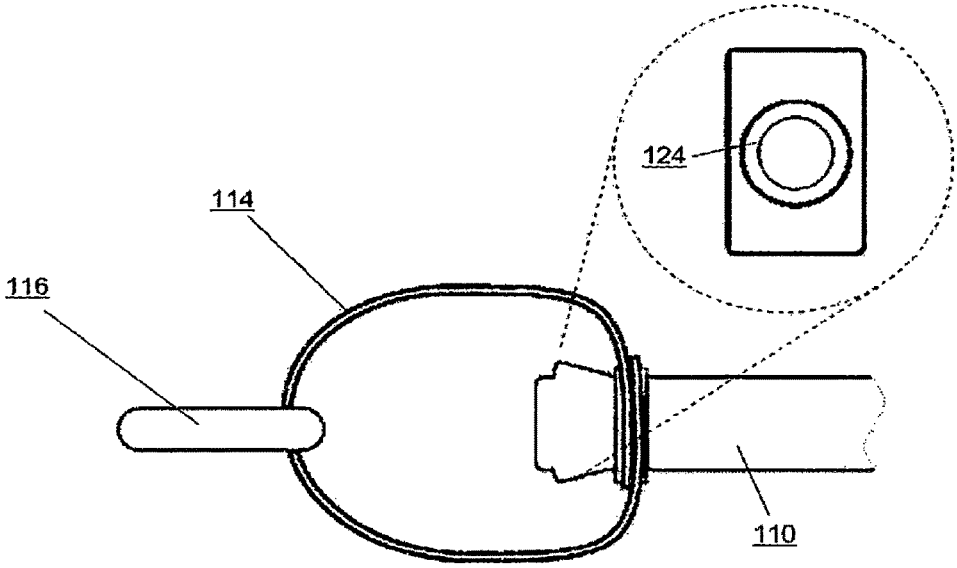
FIG. 4 illustrates a close-up view of an example configuration of a coupling between the elastic length of a resistance band and an O-ring.
Figure 5:
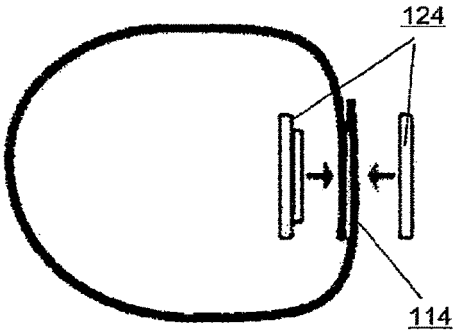
FIG. 5 illustrates an exploded view of the components of the coupling shown in FIG. 4.

Referring to FIG. 4 and FIG. 5 a close-up view and exploded view of an example configuration of a coupling between the elastic length of a resistance band 110 and an O-ring 116 is shown. This type of coupling can be used between each end of each resistance band and the first and second O-rings mentioned above, but other configurations can also be used.

In the example configuration, the nylon loop 114 is formed of a single strip with openings at either end. This strip is wrapped around into a loop with the openings each overlaid with one another and a two-piece grommet 124 sandwiches them together, forming the nylon loop. The elastic length of the resistance band 110 can then be threaded through the opening of the grommet 124, and if the end of the elastic length is thicker than the diameter of the grommet 124 opening then this will from a secure connection. The nylon loop 114 is also threaded through the opening of the O-ring 116, 106, before the grommet 124 is applied, forming a secure connection between the O-ring and the length of elastic 110.

Figure 6:
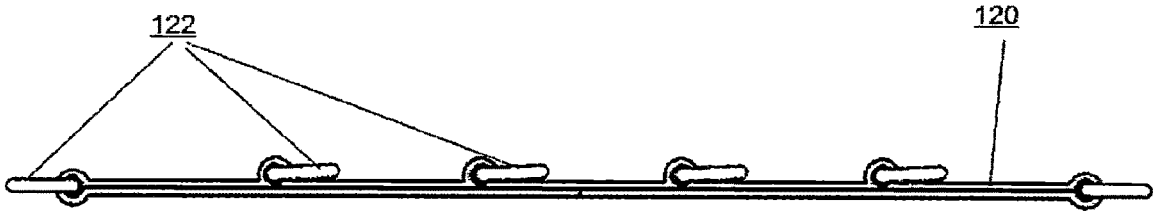
FIG. 6 illustrates a first isometric side view of a length of webbing having D-rings disposed along its length for use in the disclosed apparatus.
Figure 7:
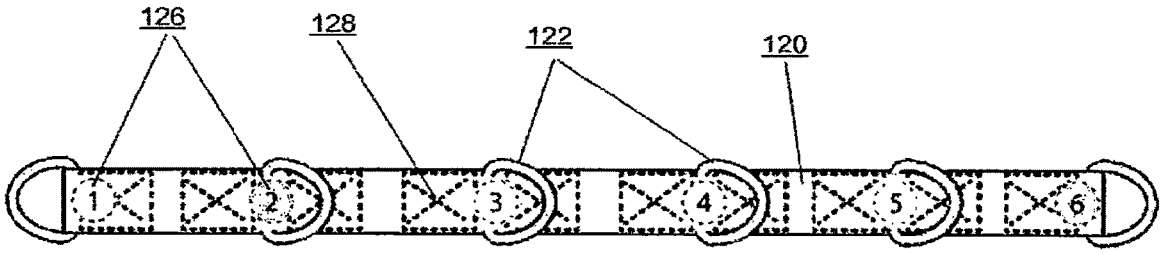
FIG. 7 illustrates a second isometric front view of the length of webbing.

Referring to FIG. 6 and FIG. 7, a side view and a frontal view of a length of webbing 120 having D-rings 122 disposed along its length is shown in more detail.

In the present example the webbing 120 has D-rings disposed at either end and four other D-rings disposed evenly along its length, for a total of 6. Each D-ring 122 is thus labelled with a number 126 between 1 and 6, allowing a user to quickly recognized and record which length they are setting the second carabiner 118 at for a given exercise, which is useful for achieving consistent ranges of motion for each user of different heights and limb lengths, and for each particular exercise and given anchor position, and gaining more insight into performance and improvement in different exercises over a time period.

The webbing 120 in the present example is formed of a single long strip of nylon which has been wrapped over itself with the opposing ends meeting in the middle of the rear surface, and then cross stitching 128 has been applied to form it into a reinforced strap.

The D-rings, and the O-rings mentioned above, are generally formed of steel or another suitably resilient material.

Figure 8:
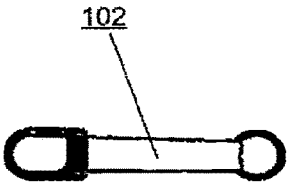
FIG. 8 illustrates an isometric side view of an example handle for use in the disclosed apparatus.

Referring to FIG. 8, an example handle 102 for use in the disclosed apparatus is shown. As mentioned above, the handle 102 is generally formed of a plastic tube with a nylon loop threaded through and may also comprise another coupling mechanism such as a clip for attaching to the first carabiner 104. Handles of this type are common in the field of exercise equipment and often come prefabricated.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the resistance band apparatus have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A resistance band apparatus, comprising:

a handle;

a first carabiner coupled to the handle;

two or more resistance bands, each resistance band comprising a length of elastic material having a first O-ring disposed at a first end of the length of elastic which is configured to detachably couple to the first carabiner and a second O-ring at the opposing end;

a second carabiner coupled to the second O-ring of each resistance band; and a length of webbing having a first D-ring at one end of the length which attaches to the second carabiner and one- or more second D-rings disposed along its length to couple to the second O-rings of the resistance bands, each D-ring having a corresponding label;

wherein each resistance band is configured with a thickness to provide a set profile of elastic resistance to deformation by stretching which is different from each other resistance band of the apparatus, the thickness and thus level of resistance provided by each resistance band being indicated by a marking or coloration of the band; and wherein the length of webbing having the D-rings disposed along its length is a single piece of nylon wrapped around in a loop with the ends meeting in the middle.

2. A resistance band apparatus according to claim 1, wherein the apparatus further comprises a fabric sheath, configured to enclose and hold together each of the resistance bands.

3. A resistance band apparatus according to claim 2, wherein the sheath is a piece of nylon fabric, provided with hook and loop elements to detachably wrap around the two or more resistance bands.

4. A resistance band apparatus according to claim 1, wherein the apparatus further comprises a clear plastic tube configured to enclose and hold together each of the resistance bands.

5. A resistance band apparatus according to claim 1, wherein the first and/or second end of the elastic length of each resistance band is attached to the second O-ring by a webbing loop.

6. A resistance band apparatus according to claim 5, wherein the coupling between the length of elastic and the webbing loop is formed by passing the elastic length through a grommet that overlaps the ends of the webbing loop, holding it together, the elastic length of each resistance band having a thicker profile at the end(s) so as to have a greater diameter than a width of the opening of the grommet(s).

7. A resistance band apparatus according to claim 1, wherein the handle comprises a plastic tunnel grip having a length of nylon webbing looped through, and the nylon webbing couples to the first carabiner.

8. A resistance band apparatus according to claim 1, wherein the apparatus comprises five resistance bands of different colors and resistances, such that a user may control the total resistance level provided by the apparatus on a scale of 1-15 by attaching different numbers of the first O-rings to the first carabiner.

9. A resistance band apparatus according to claim 1, wherein the D-rings on the length of webbing are evenly spaced from one another and labelled numerically to provide users with a range of length settings which are uniform and easily recorded.

10. A resistance band apparatus according to claim 1, wherein the length of provided with box stitching along its length to from a solid strap.

* * * * *